US008511395B2

(12) United States Patent
Hosfield et al.

(10) Patent No.: US 8,511,395 B2
(45) Date of Patent: Aug. 20, 2013

(54) REDUNDANT STATIONARY FIRE FIGHTING SYSTEM AND METHOD

(75) Inventors: Robert L. Hosfield, Centerville, MN (US); Jonathan Gamble, Taylors Falls, MN (US); Jim Weigle, Crystal River, FL (US)

(73) Assignee: Sta-Rite Industries, LLC, Delavan, WI (US)

( * ) Notice: Subject to any disclaimer, the term of this patent is extended or adjusted under 35 U.S.C. 154(b) by 259 days.

(21) Appl. No.: 12/879,702

(22) Filed: Sep. 10, 2010

(65) Prior Publication Data

US 2012/0061107 A1 Mar. 15, 2012

(51) Int. Cl.
*A62C 2/00* (2006.01)

(52) U.S. Cl.
USPC ..... 169/44; 169/14

(58) Field of Classification Search
USPC ..... 169/44, 45, 46, 54, 55, 64–66, 5, 169/16, 17, 14
See application file for complete search history.

(56) References Cited

U.S. PATENT DOCUMENTS

| | | | | |
|---|---|---|---|---|
| 3,940,931 | A | 3/1976 | Renfro et al. | |
| 3,973,257 | A * | 8/1976 | Rowe | 340/511 |
| 4,474,680 | A * | 10/1984 | Kroll | 516/10 |
| 5,232,052 | A * | 8/1993 | Arvidson et al. | 169/14 |
| 5,494,112 | A | 2/1996 | Arvidson et al. | |
| 6,684,959 | B1 | 2/2004 | Juidici et al. | |
| 2008/0236846 | A1 | 10/2008 | Gamble et al. | |
| 2009/0200045 | A1 | 8/2009 | Hosfield et al. | |

* cited by examiner

*Primary Examiner* — Davis Hwu
(74) *Attorney, Agent, or Firm* — Quarles & Brady LLP

(57) ABSTRACT

Embodiments of the invention provide a redundant stationary fire fighting system and method for use in a structure coupled to a water supply and a main water pump(s) that generates a water stream. The system includes one or more water flow meters to measure the water stream and generate a water flow signal. The system includes a primary foam proportioning system and a redundant secondary foam proportioning system, each including a foam pump, a motor, a foam flow meter, and a controller. The controller is configured to automatically operate the foam pump based on the water flow signal in order to inject liquid foam concentrate directly into the water stream. The redundant secondary foam proportioning system can be automatically started in case of component failure in the primary foam proportioning system.

14 Claims, 2 Drawing Sheets

REDUNDANT STATIONARY FIRE FIGHTING SYSTEM AND METHOD

BACKGROUND

Stationary fire fighting systems have been developed for use in structures, chemical facilities and petrochemical plants for manufacturing or storage, such as existing buildings or new buildings, enclosed chemical plants, or enclosed or outdoor storage or manufacturing facilities. Stationary fire fighting systems with foam proportioning capabilities generally include a water flow meter, a controller, and a foam pump. The controller operates the foam pump based on the signal from the water flow meter to supply liquid foam concentrate or foamant to a water stream. The mixed foamant and water is then delivered through pipes in the building and sprayed with sprinklers to extinguish the fire. Currently, stationary foam proportioning systems use venturi-based technologies, such as in-line eductors, around-the-pump eductors, balanced-pressure systems, and other fixed-delivery mechanisms. However, these technologies can cause an undesirable pressure drop in water pressure. Reduced water pressure causes operating problems because the length of some pipes in buildings can be 400 to 500 feet or longer. To maintain full flow and maximize the effectiveness of the mixture being sprayed with the sprinklers, water pressure drop should be minimized.

In addition, balanced-pressure systems can be difficult to maintain. Bladder-type systems must be cleaned, the foamant must be disposed of, and the pressure vessels must be tested and reworked. During this maintenance time, the fire fighting system cannot be used and the building is left without protection. This maintenance work is also expensive, time consuming, and can cause environmental problems due to discarded foamant. During operation, balanced-pressure type foamant systems that use positive displacement pumps often "by-pass" foamant or recirculate foamant back to the foamant tank, which causes undesirable foaming and possible degradation of the new foamant in the tank.

SUMMARY

Some embodiments of the invention provide a redundant stationary fire fighting system and d method for use in a structure. The system is coupled to a water supply and a main water pump that generates a water stream. The system can include one or more water flow meters to measure the water stream and generate a water flow signal. The system can include a primary foam proportioning system including a first foam pump, a first motor, a first foam flow meter, and a first controller. The first controller can be configured to automatically operate the first foam pump based on the water flow signal in order to inject liquid foam concentrate directly into the water stream. The system can also include a redundant secondary foam proportioning system including a second foam pump, a second motor, a second foam flow meter, and a second controller. The redundant secondary foam proportioning system can be automatically started in case of component failure in the primary foam proportioning system. The second controller can be configured to automatically operate the second foam pump based on the water flow signal in order to inject liquid foam concentrate directly into the water stream.

DETAILED DESCRIPTION

Figure 1:
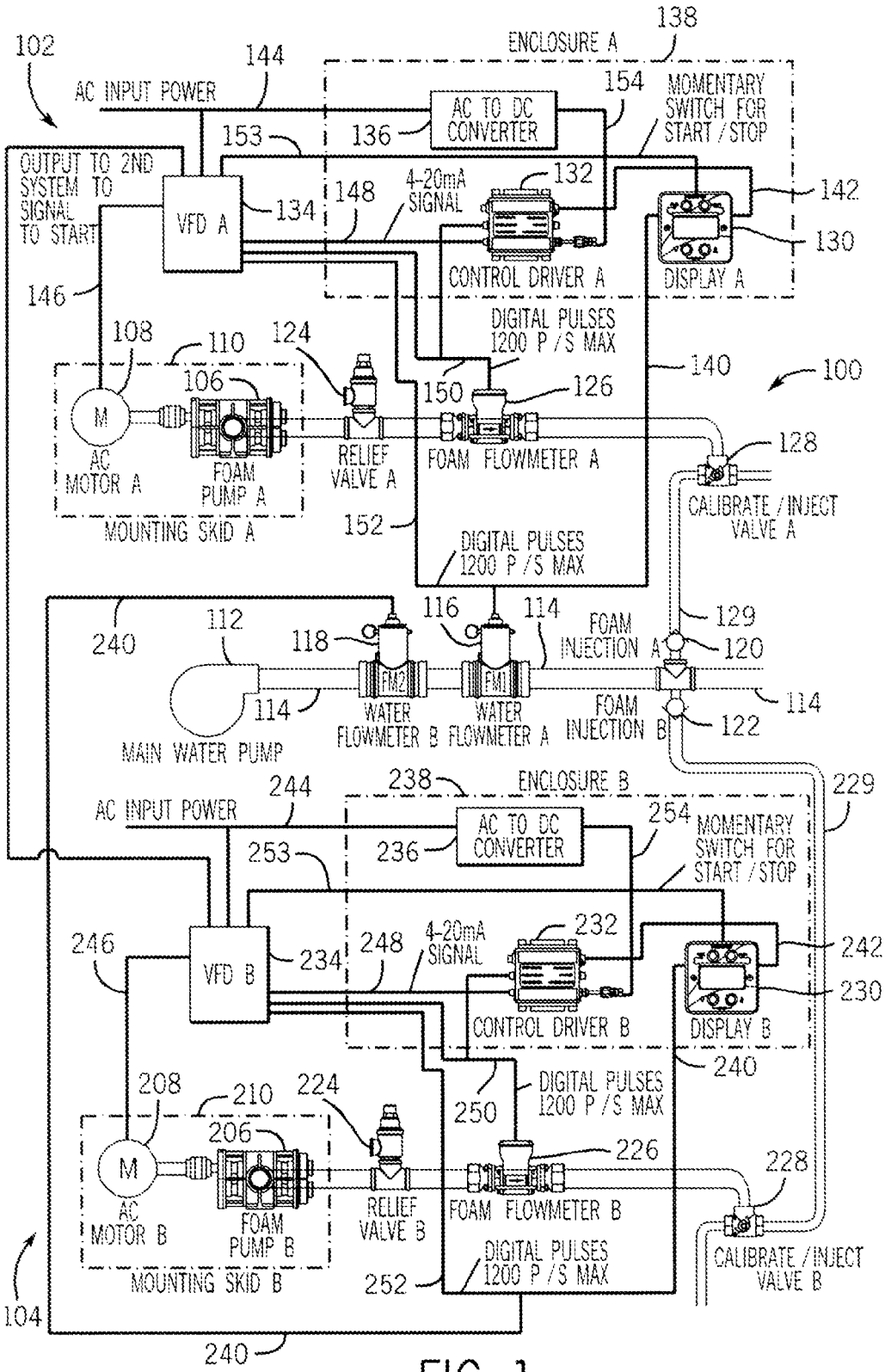
FIG. 1 is a schematic diagram of a redundant stationary foam proportioning system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a redundant stationary fire fighting system 100 according to one embodiment of the invention. The system 100 can include stationary foam proportioning systems for use in buildings, such as a residential, commercial, or industrial buildings, complexes, or high-rises, as shown and described in U.S. patent application Ser. No. 12/077,982, filed on Mar. 24, 2008, the entire contents of which is herein incorporated by reference. The system 100 can mix water and an additive that helps to fight fires, such as liquid foam concentrate or foamant, in order to create an aqueous fire suppressive solution. The system 100 can be connected to an isolated or dedicated water supply (e.g., a water storage tank, etc.) or to an existing or potable water supply (e.g., a city water main, a well, a lake, etc.). The water supply can deliver water to the system 100 at a pressure between about 7 psi and about 500 psi or more. In some embodiments, the water supply can deliver water to the system 100 at a pressure between about 15 and about 120 pounds per square inch (psi). Other embodiments of the invention can operate over other suitable pressure ranges.

The additive, such as foam concentrate, can be in the form of a liquid, gas, powder, or solid. In some embodiments, the system 100 can be configured for use with Class A foam concentrate capable of suppressing Class A fires. Class A fires include fires involving ordinary combustible, such as, for example, paper, wood, cloth, grass, etc. Additionally or alternatively, the system 100 can be configured for use with Class B foam concentrate capable of suppressing Class B fires (i.e., fires involving flammable liquids), as well as other types of foam concentrates. In general, the system 100 can be compatible with Class A, Class B, and other types of foam concentrate. Also, rather than foam concentrate, the system 100 can be compatible with other types of additives that help fight fires. In addition, the system 10 can be configured to comply with the following standards: NFPA 1145, NFPA 1150, NFPA 13, NFPA 13D, NFPA 13E, NFPA 13R, NFPA 11, NFPA 16, NFPA 20, NFPA 72, NFPA 409, UL 162, UL 199, UL 1626, FM 2030, as well as other fire suppression foam equipment standards.

As shown in FIG. 1, the system 100 can include a primary foam proportioning system 102 and a redundant foam proportioning secondary system 104. The redundant secondary system 104 can be automatically started in case of component failure in the primary system 102. The primary system 102 can include a foam pump 106 and a motor 108 (e.g., an AC motor). In some embodiments, the foam pump 106 and the motor 108 can be positioned on a first mounting skid 110. The primary system 102 and the secondary system 104 can be in fluid communication with a main water pump 112 coupled to the water supply (not shown). The foam pump 106 can deliver foamant to the water stream generated by the water pump 112 through a pipe 114. The pipe 114 can be in fluid communication with a first water flow meter 116 and a second water flow meter 118. The pipe 114 can also be in fluid communication with a first foam injection port 120 and a second foam injection port 122, each of which can include a backflow preventer. The backflow preventers can be, for example, UL listed backflow preventers meeting the NFPA 13 standard. The backflow preventers can inhibit water and/or additive from flowing back toward the water supply. From the foam pump 106, foamant flows through a foam relief valve 124 and through a foam flow meter 126 to a calibrate/inject valve 128. The calibrate/inject valve 128 then delivers foamant to the water stream via a pipe 129 and the first foam injection port 120. The mixture of water and foamant is then delivered to sprinklers in the building through the pipe 114.

The primary system 102 can also include a display controller 130, a control driver 132, a variable frequency drive 134, and an AC to DC converter 136. In one embodiment, the display controller 130, the control driver 132, and the AC to DC converter 136 can be housed together in a first enclosure 138 (e.g., the enclosure shown and described in U.S. patent application Ser. No. 12/077,982). In one embodiment, the first mounting skid 110 with the foam pump 106 and motor 108 can be positioned inside a bottom portion of the first enclosure 138. In some embodiments, the display controller 130, the control driver 132, and the AC to DC converter 136 can be integrated with the variable frequency drive 134.

In some embodiments, the foam pump 106 can be an electronic, fully automatic, variable speed, direct injection, discharge side pump. The foam pump 106 can be a positive displacement pump coupled to the motor 108, and the variable frequency drive 134. In general, positive-displacement pumps displace a known quantity of liquid with each revolution of the pumping elements. This is done by trapping liquid between the pumping elements and a stationary casing. Pumping element designs can include gears, lobes, rotary pistons, vanes, and screws. Positive-displacement pumps also have relatively compact designs, high-viscosity performance, continuous flow regardless of differential pressure, and the ability to handle high differential pressure. In some embodiments, the positive displacement pump can operate at over 500 gpm and over 300 psi. In some embodiments, the positive displacement pump can operate at up to about 400 psi. In some embodiments, the foam pump 106 can include a self-test capability.

The motor 108 can be an AC type motor coupled to the positive displacement pump 106. The variable frequency drive 134 can be mounted to a base of the pump 106 or the motor 108 and can receive signals from the display controller 130 to control the motor 108. The variable frequency drive 134 can use a variable speed duty cycle and/or closed-loop control to ensure that the correct proportion of foamant (e.g., as preset by an operator) is injected into the water stream.

In some embodiments, the display controller 130 can be a digital electronic display suitable for installation on a panel of the first enclosure 138. The display controller 130 can include a microprocessor that receives inputs from the first water flow meter 116 via a line 140. The water flow meter 116 can be a paddlewheel-type flow sensor. The display controller 130 can also be connected to the control driver 132 via a line 142. In some embodiments, the display controller 130 can be configured to display or perform one or more of the following operations: display the current flow-per-minute of water; display the total volume of water discharged during and after operations are completed; display the total amount of additive consumed; display the total amount of additive remaining; simulate flow rates for manual operation and/or remote testing; perform setup, calibration, and diagnostic functions for installation and testing; display and report a "low concentrate" warning when an additive supply tank runs low; display and report a "no concentrate" warning and shut the positive displacement pump off, preventing damage to the pump 106 should the additive supply tank become empty; display and report a "power fault" when the system 100 loses an electrical power connection; and/or display and report a "test fault" when the system 100 fails any self diagnostic tests. In some embodiments, some information from the display controller 130, such as the additive level, the additive flow rate, the water flow rate, the operating mode, and the power supply status, can be remotely readable over a suitable network.

An AC input power line 144 can connect the primary system 102 to the AC to DC converter 136 in order to provide a dedicated circuit capable of providing AC or DC power, such as 120 $V_{AC}$ power. The AC input power line 144 can also be connected to the variable frequency drive 134. In one embodiment, the maximum power used by the primary system 102 can be less than about 1200 Watts and 10 amps in an active state (i.e., running or operating state) and less than about 24 Watts and 200 milliamps in the quiescent state (i.e., non-operating state).

The variable frequency drive 134 can be connected to the motor 108 via a line 146, to the control driver 132 via a line 148, to the foam flow meter 126 via a line 150, and to the display controller 130 via lines 152 and 153. The control driver 132 can be connected to the display controller 130 via the line 142, to the variable frequency drive 134 via the line 148, to the foam flow meter 126 via the line 150, to the AC to DC converter via a line 154.

The redundant secondary system 104 can include generally the same components as the primary system 102, as also shown in FIG. 1. The redundant secondary system 104 can include a foam pump 206 and a motor 208 (e.g., an AC motor). In some embodiments, the foam pump 206 and the motor 208 can be positioned on a second mounting skid 210. The redundant secondary system 204 can be in fluid communication with the main water pump 112 coupled to the water supply (not shown). The foam pump 206 can deliver foamant to the water stream generated by the water pump 112 through the pipe 114. The pipe 114 can also be in fluid communication with the second foam injection port 122, which can include a backflow preventer. From the foam pump 206, foamant can flow through a foam relief valve 224 and through a foam flow meter 226 to a calibrate/inject valve 228. The calibrate/inject valve 228 then delivers foamant to the water stream via a pipe 229 and the second foam injection port 122. The mixture of water and foamant is then delivered to sprinklers in the building through the pipe 114.

The redundant secondary system 104 can also include a display controller 230, a control driver 232, a variable frequency drive 234, and an AC to DC converter 236. In one embodiment, the display controller 230, the control driver 232, and the AC to DC converter 236 can be housed together in a second enclosure 238 (e.g., the enclosure shown and described in U.S. patent application Ser. No. 12/077,982). In one embodiment, the second mounting skid 210 with the foam pump 206 and motor 208 can be positioned inside a bottom portion of the second enclosure 238.

The display controller 230 can include a microprocessor that receives inputs from the second water flow meter 118 via a line 240. The display controller 230 can also be connected to the control driver 232 via a line 242.

An AC input power line 244 can connect the redundant secondary system 104 to the AC to DC converter 236 in order to provide a dedicated circuit capable of providing AC or DC power, such as 120 $V_{AC}$ power. The AC input power line 244 can also be connected to the variable frequency drive 234.

The variable frequency drive 234 can be connected to the motor 208 via a line 246, to the control driver 232 via a line 248, to the foam flow meter 226 via a line 250, and to the display controller 230 via lines 252 and 253. The control driver 232 can be connected to the display controller 230 via the line 242, to the variable frequency drive 234 via the line 248, to the foam flow meter 226 via the line 250, and to the AC to DC converter via a line 254.

In some embodiments, while operating the primary system 102, the flow meter 116 supplies flow information to the display controller 130 to determine the water volume to treat. The display controller 130 varies the control signal sent via the line 153 to the variable frequency drive 134 to proportionally vary the speed of the positive displacement foam pump 106. The positive displacement foam pump 106 can inject foam concentrate directly into the high pressure water stream (flowing through the pipe 114) with no flow restrictions and no loss of line pressure. The positive displacement foam pump 106 can also eliminate the need for recirculating foam to the foam tank (not shown) and does not require extensive maintenance or incur environmental problems associated with calibration. In case of failure of the flow meter 116, the display controller 130, and/or the foam pump 106, the variable frequency drive 134 can automatically transfer control to the redundant secondary system 104.

Figure 2:
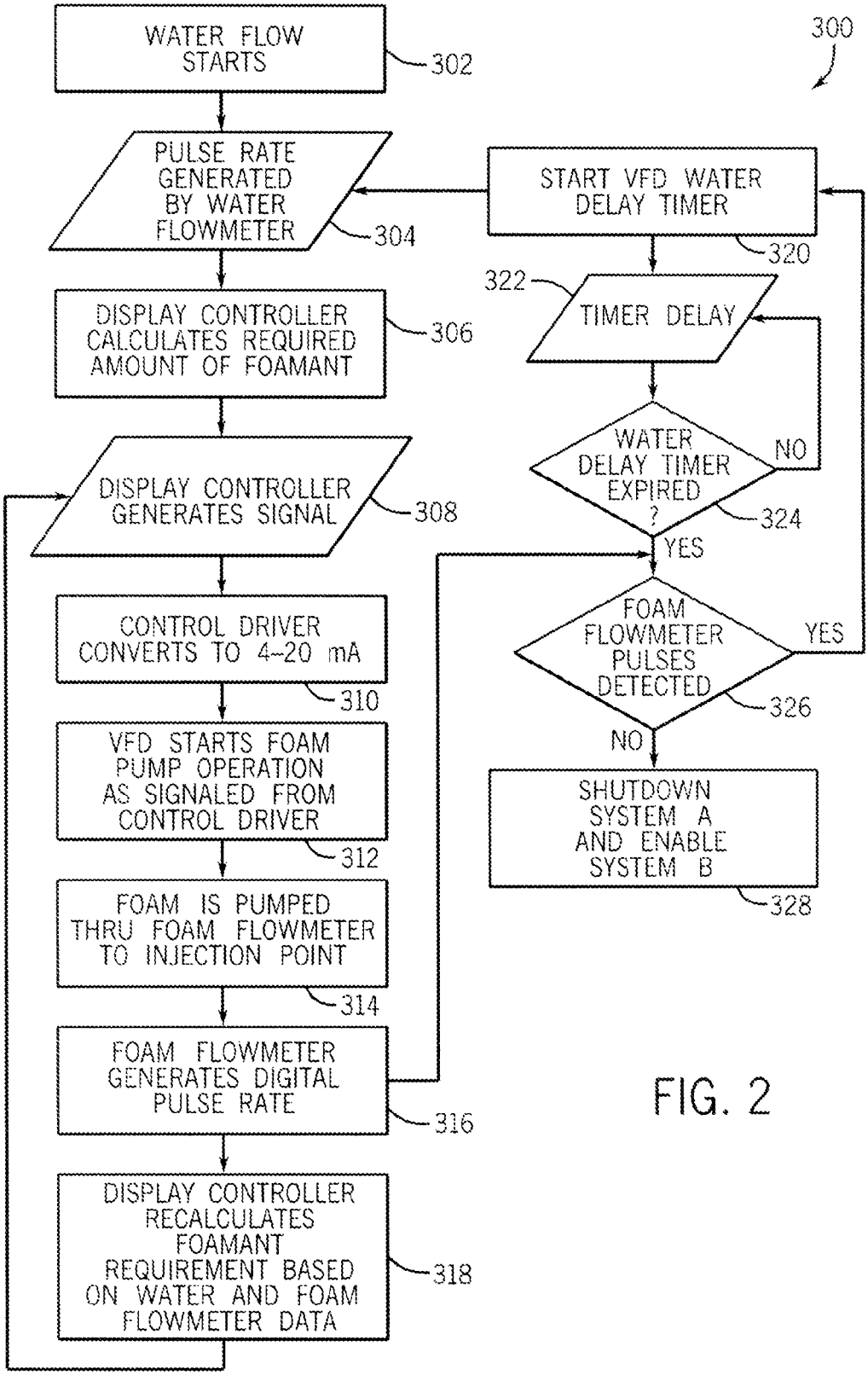
FIG. 2 is a flow chart of a method of operating the redundant stationary foam proportioning system of FIG. 1 according to one embodiment of the invention.

FIG. 2 is a flowchart of a control method 300 according to one embodiment of the invention for the system 100. The system 100 starts (at 302) when valves are opened to start water flow. The first water flow meter 116 sends (at 304) a water flow signal to indicate that water is flowing (e.g., a digital pulse signal of 1200 pulses per second maximum) to the display controller 130 via the line 140 and to the variable frequency drive 134 via the line 152. Recognizing the signal from water flow meter 116, the display controller 130 calculates (at 306) the correct amount of foam to inject into the water based on the pulses from the water flow meter 116 and a preset percentage injection rate stored in memory in the display controller 130. The display controller 130 then generates (at 308) a signal via line 142 to the control driver 132. The control driver 132 converts (at 310) the signal to a proportional signal (e.g., a 4-20 mA proportional signal). The control driver 132 sends the proportional signal via line 148 to the variable frequency drive 134. The variable frequency drive 134 starts (at 312) rotation of foam pump 106 by driving the motor 108 to the speed prescribed by the signal on line 146. The foam pump 106 pumps (at 314) foamant through the foam flow meter 126 to the calibrate/inject valve 128 and through the first foam injection port 120 and into the water stream in the pipe 114.

The foam flowing out of the foam pump 106 passes through the foam flow meter 126 which generates (at 316) a digital pulse signal via the line 150 to the control driver 132 and to the variable frequency drive 134. The variable frequency drive 134 uses the digital pulse signal to verify that foam is flowing and to continue operations. The control driver 132 and display controller 130 compare the digital pulse signal generated by the foam flow meter 126 and recalculate (at 318) the foamant requirement in order to adjust the signal sent to the variable frequency drive 134 to increase or decrease the speed of the foam pump 106 so that it matches the expected foam output. The process is repeated by returning to step 308 and is updated substantially continuously during operation to ensure the proper amount of foamant is injected into the water stream over a wide range of water flow rates.

If no signal is received by variable frequency drive 134 from the foam flow meter 126, a water delay timer can be started (at 320). The water delay timer operates (at 322) until the delay time period has expired (at 324). After the delay time period has expired, the variable frequency drive 134 can try to detect (at 326) pulses from the foam flow meter 126. If no pulses are detected, the variable frequency drive 134 can shut down (at 328) operation of the primary system 102 and can send a signal to the redundant secondary system 104 to automatically start and/or can signal an operator that the primary system 102 is not operating properly. For example, the variable frequency drive 134 can send a signal to the display controller 230 to enable and start the process control through the redundant secondary system 104. If redundant secondary system 104 does not start, an alarm can be generated or a third foam proportioning system can be started.

Some embodiments of the system 100 can help prevent pressure drops, maintenance issues, and recirculation problems. Some embodiments of the system 100 allow a technician to test or service the system 100 using a simulated flow feature in the display controller 130 or 230 to simulate water flow. By using the calibrate/inject valve 128 or 228, the foam flow can be diverted to a container or vessel for quality testing, calibration testing, or system testing. This can be done in a service mode without actually running the main water stream or wasting valuable foam concentrate or incurring environmental disposal risk.

Other features of the system 100 include, but are not limited to, tracking the amount of water used, tracking the amount of foam concentrate used, checking for adequate levels of foam supplying the foam pump 106, and automatically stopping operations when water flow stops.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A stationary fire fighting system for use in a structure, the system being coupled to a water supply and a main water pump that generates a water stream, the system comprising:

at least one water flow meter to measure the water stream and generate a water flow signal;

a primary foam proportioning system including a first foam pump, a first motor, a first foam flow meter, and a first controller, the first controller configured to automatically operate the first foam pump based on the water flow signal in order to inject liquid foam concentrate directly into the water stream;

a redundant secondary foam proportioning system including a second foam pump, a second motor, a second foam flow meter, and a second controller, the redundant secondary foam proportioning system being automatically started in case of component failure in the primary foam proportioning system, the second controller configured to automatically operate the second foam pump based on the water flow signal in order to inject liquid foam concentrate directly into the water stream; and wherein the at least one water flow meter includes a first water flow meter and a second water flow meter in fluid communication with the water supply, the first water flow meter being in fluid communication with the primary foam proportioning system, and the second water flow meter being in fluid communication with the redundant secondary foam proportioning system.

2. The system of claim 1 wherein the first foam pump and the second foam pump are positive displacement pumps.

3. The system of claim 2 wherein the positive displacement pumps inject the liquid foam concentrate directly into the water stream with no flow restrictions and no loss of water pressure.

4. The system of claim 2 wherein the first motor and the second motor each include a variable frequency drive to proportionally vary a speed of the positive displacement pumps.

5. The system of claim 1 wherein the first controller and the second controller each include a display controller, a control driver, and a AC to DC converter.

6. The system of claim 5 wherein the first motor and the second motor each include a variable frequency drive.

7. The system of claim 6 wherein the at least one water flow meter sends a water flow signal to the display controller and the variable frequency drive.

8. The system of claim 7 wherein the display controller calculates an amount of liquid foam concentrate to inject into the water stream based on the water flow signal from the at least one water flow meter and a preset percentage injection rate stored in memory.

9. The system of claim 8 wherein the display controller sends a pulse width modulated signal to the control driver and the control driver sends a proportional signal to the variable frequency drive in order to control a speed of the first foam pump.

10. The system of claim 9 wherein the first foam flow meter sends a digital pulse signal to the control driver and the variable frequency drive.

11. The system of claim 10 wherein the display controller adjusts the signal to the control driver in order to change the speed of the first foam pump via the variable frequency drive.

12. The system of claim 11 wherein if the variable frequency drive does not receive a signal from the first foam flow meter during a predetermined time period, the variable frequency drive shuts down the first motor and signals the redundant secondary foam proportioning system to operate by sending a signal to the second display controller.

13. The system of claim 1 wherein the primary foam proportioning system and the redundant secondary foam proportioning system are both in fluid communication with a single main water supply.

14. The system of claim 1 wherein the first foam pump is in fluid communication with a first calibrate/inject valve and the second foam pump is in fluid communication with a second calibrate/inject valve, the first calibrate/inject valve and the second calibrate/inject valve in fluid communication with the water stream.

* * * * *